US009163372B1

(12) United States Patent
Elston

(10) Patent No.: US 9,163,372 B1
(45) Date of Patent: Oct. 20, 2015

(54) THREE-HANDLED SNOW SHOVEL

(71) Applicant: Dennis Elston, Flint, MI (US)

(72) Inventor: Dennis Elston, Flint, MI (US)

( * ) Notice: Subject to any disclaimer, the term of this patent is extended or adjusted under 35 U.S.C. 154(b) by 0 days.

(21) Appl. No.: 14/656,709

(22) Filed: Mar. 13, 2015

Related U.S. Application Data

(60) Provisional application No. 62/027,565, filed on Jul. 22, 2014.

(51) Int. Cl.
*B25G 3/38* (2006.01)
*E01H 5/02* (2006.01)
*A01B 1/02* (2006.01)

(52) U.S. Cl.
CPC . *E01H 5/02* (2013.01); *A01B 1/026* (2013.01)

(58) Field of Classification Search
CPC ..... A01B 1/026; E01H 5/02
USPC ..... 294/58, 178
See application file for complete search history.

(56) References Cited

U.S. PATENT DOCUMENTS

| | | | | | |
|---|---|---|---|---|---|
| 519,515 | A | * | 5/1894 | Walsh | 294/58 |
| 2,521,441 | A | | 9/1950 | Bickley | |
| 2,772,910 | A | | 12/1956 | Doyle | |
| 2,826,835 | A | | 6/1958 | O'shea | |
| 4,264,096 | A | * | 4/1981 | Barnett | 294/58 |
| 5,133,582 | A | * | 7/1992 | Rocha | 294/58 |
| 5,400,471 | A | | 3/1995 | Lichfield | |
| 5,447,349 | A | * | 9/1995 | Coble | 294/58 |
| 5,472,252 | A | | 12/1995 | Barone | |
| 5,704,672 | A | | 1/1998 | Sims | |
| 5,921,600 | A | * | 7/1999 | Lucas | 294/58 |
| D441,623 | S | | 5/2001 | Storlie | |
| 6,485,076 | B1 | | 11/2002 | Chang | |
| 6,883,845 | B2 | | 4/2005 | Douziech | |
| D716,119 | S | | 10/2014 | Elston | |

* cited by examiner

*Primary Examiner* — Dean Kramer
(74) *Attorney, Agent, or Firm* — Mitchell Law PLLC; Matthew W. Mitchell

(57) ABSTRACT

A three-handled snow shovel is disclosed. The shovel includes a first shaft having upper and lower ends defining a longitudinal axis, a shovel blade having top and bottom edges, a concave front side and a convex rear side, a first handle at the upper end of the first shaft defining a first axis, the first handle having a first grip, the first grip capable of rotating about the first axis, a second handle assembly comprising a second shaft and a second grip, wherein the first and second shafts are selectively connected using a first hook and a first eye component and pivotally connected using a second eye component of the second shaft secured to a third eye component secured to the first shaft, and a third shaft connected to the second shaft at a substantially 90-degree angle.

20 Claims, 9 Drawing Sheets

THREE-HANDLED SNOW SHOVEL

CROSS-REFERENCE TO RELATED APPLICATIONS

This application claims the benefit of U.S. Provisional Application No. 62/027,565 filed Jul. 22, 2014 which is hereby incorporated herein by reference in its entirety.

TECHNICAL FIELD

This disclosure relates to the field of shovels, and more particularly to a three-handled snow shovel capable of three dimensional movement and engagement to a main shaft.

BACKGROUND

The statements in this section merely provide background information related to the present disclosure and may not constitute prior art.

The concept of two-handled shovels is known in the art. Some two-handled shovel embodiments include accessory handles that attach to the shaft of a conventional shovel. Some embodiments of a two-handled shovel include a second handle or shaft or a flexible cord attached to the juncture of the shovel blade and the shaft allowing the shovel to be used with both hands. The second handle provides the ability to apply extra leverage and force to the shovel in lifting and/or moving the load carried by the shovel. The second handle also permits a person to lift or move a heavier load without having to stoop or bend over and grasp the shovel handle near the blade. In moving snow, for example, the snow may be laden with moisture and be very heavy to move. Moving snow under these conditions can be very strenuous and hard on a person's arms and back.

As two-handled shovels are supported by both hands, each handle of the shovel moves along separate paths or arcs as determined by the length of a person's arms. In some embodiments each hand must turn, at the wrist, in the direction in the shovel is being moved. In one embodiment, one hand will turn inward at the wrist whereas the other will turn outward at the wrist. Rigidity between the handles may cause pain and discomfort if the shovel in the hands and wrists over the course of moving heavy or multiple loads.

In some situations a user of a two-handled shovel would prefer to grip the shovel similar to a conventional one-handled shovel or use one handle of the two-handled shovel. Known two-handled shovels are additionally problematic in in these situations as the auxiliary handle is cumbersome, or otherwise inhibits use of the shovel without being gripped.

It is, therefore, desirable to have a three-handled shovel configured for three-dimensional movement and configured to engage a main shaft when desired by a user.

SUMMARY

A shovel is disclosed. The shovel includes a first shaft having upper and lower ends defining a longitudinal axis, a shovel blade having top and bottom edges, a concave front side and a convex rear side, a first handle assembly at the upper end of the shaft defining a first axis, the first handle having a first grip, the first grip capable of rotating about the first axis, a second handle assembly comprising a second shaft and a second grip, wherein the first and second shafts are selectively connected using a hook and a first eye component and pivotally connected using a second eye component of the second shaft secured to a third eye component secured to the first shaft, and a third shaft connected to the second shaft at a substantially 90-degree angle.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
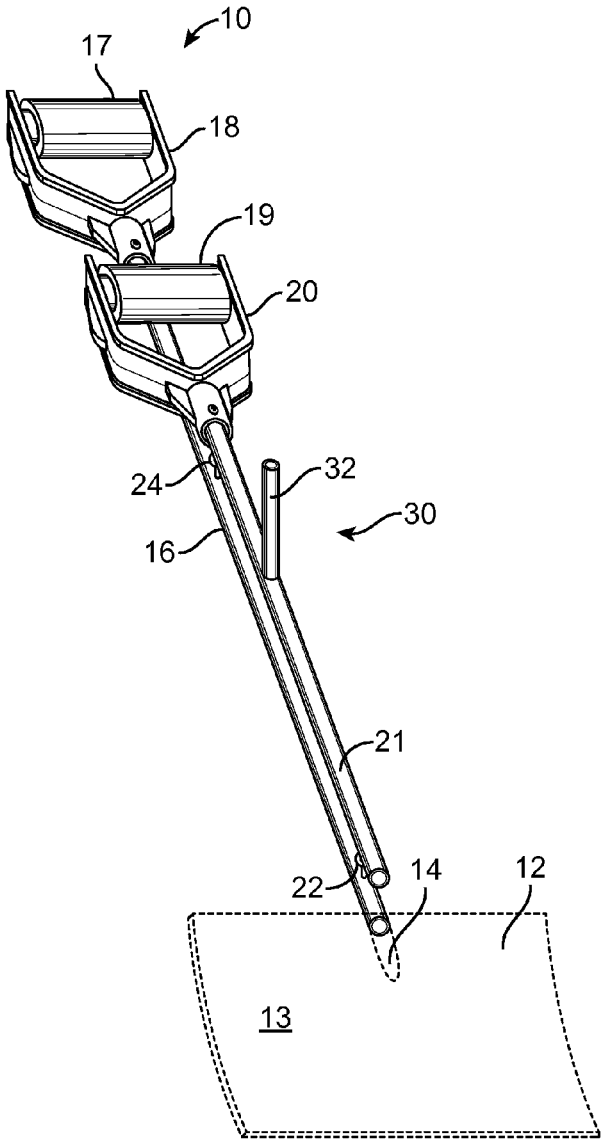
FIG. 1 is a front perspective view of the shovel of the present invention, in accordance with the present disclosure.
Figure 2:
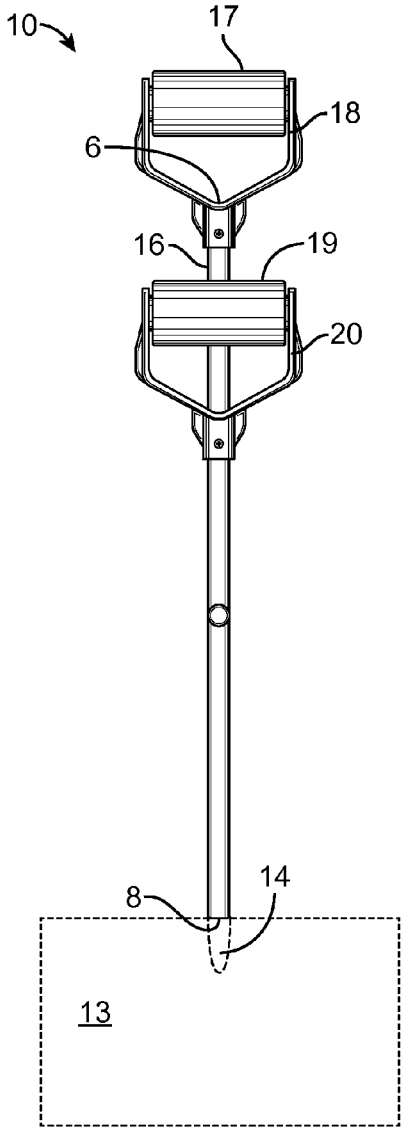
FIG. 2 is a front view of the shovel, in accordance with the present disclosure.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples or applications set forth in this specification are not intended to be limiting and merely set forth some of the many possible embodiments for the claimed invention. For example, while the present invention has an application in use with snow shovels, it is anticipated that the present invention may have application in other forms of shovels and other tools used in the lifting and moving of materials such as grass, hay, grain, soil, or coal.

Referring now to the drawings, wherein the depictions are for the purpose of illustrating certain exemplary embodiments only and not for the purpose of limiting the same, FIG. 1 shows an exemplary two-handled shovel 10 having rotatable hand grips 17 and 19 at each handle 18 and 20, respectively. As shown in FIGS. 1-5, the shovel 10 includes a blade 12 having a concave front surface 13 and a convex rear surface 15. On rear surface 15 is shaft insert sleeve 14 which receives the lower end of a shaft 16. The first shaft 16 has an upper end 6 and a lower end 8 that defines a longitudinal axis. The handle 18 is mounted on an upper end 6 of the shaft 16. The handle 18 is preferably a D-shaped handle and has rotatable hand grip 17.

The shovel 10 further includes a second handle assembly 30 including a second shaft 21 secured to the first shaft 16 via two interconnected eye screws or eye bolts 22 and 26 at a lower position. The second shaft 21 is selectively connected to the first shaft 16 at an upper position using a third eye screw or bolt 24 and a hook 28. A third shaft 32 is connected to the second shaft 21 preferably at a substantially 90-degree angle. The third shaft 32 functions as a third handle, permitting a user to push or pull a particularly heavy load. The third shaft may be integral to the second shaft 21 or mechanically attached using, e.g., a screw.

Figure 4:
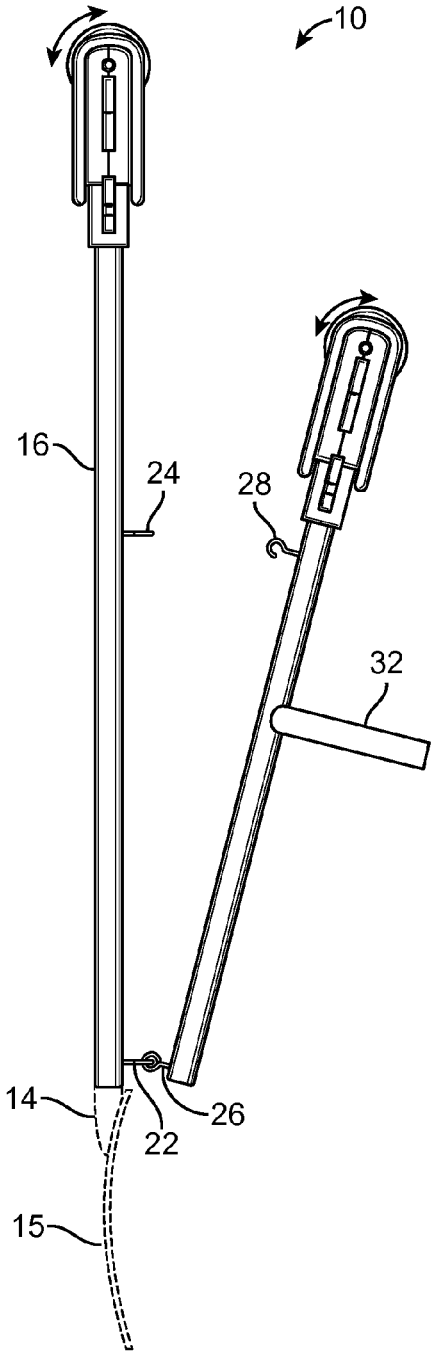
FIG. 4 is a left side view of the shovel having the second shaft unattached to the main shaft, as seen from a left side of FIG. 2, in accordance with the present disclosure.
Figure 5:
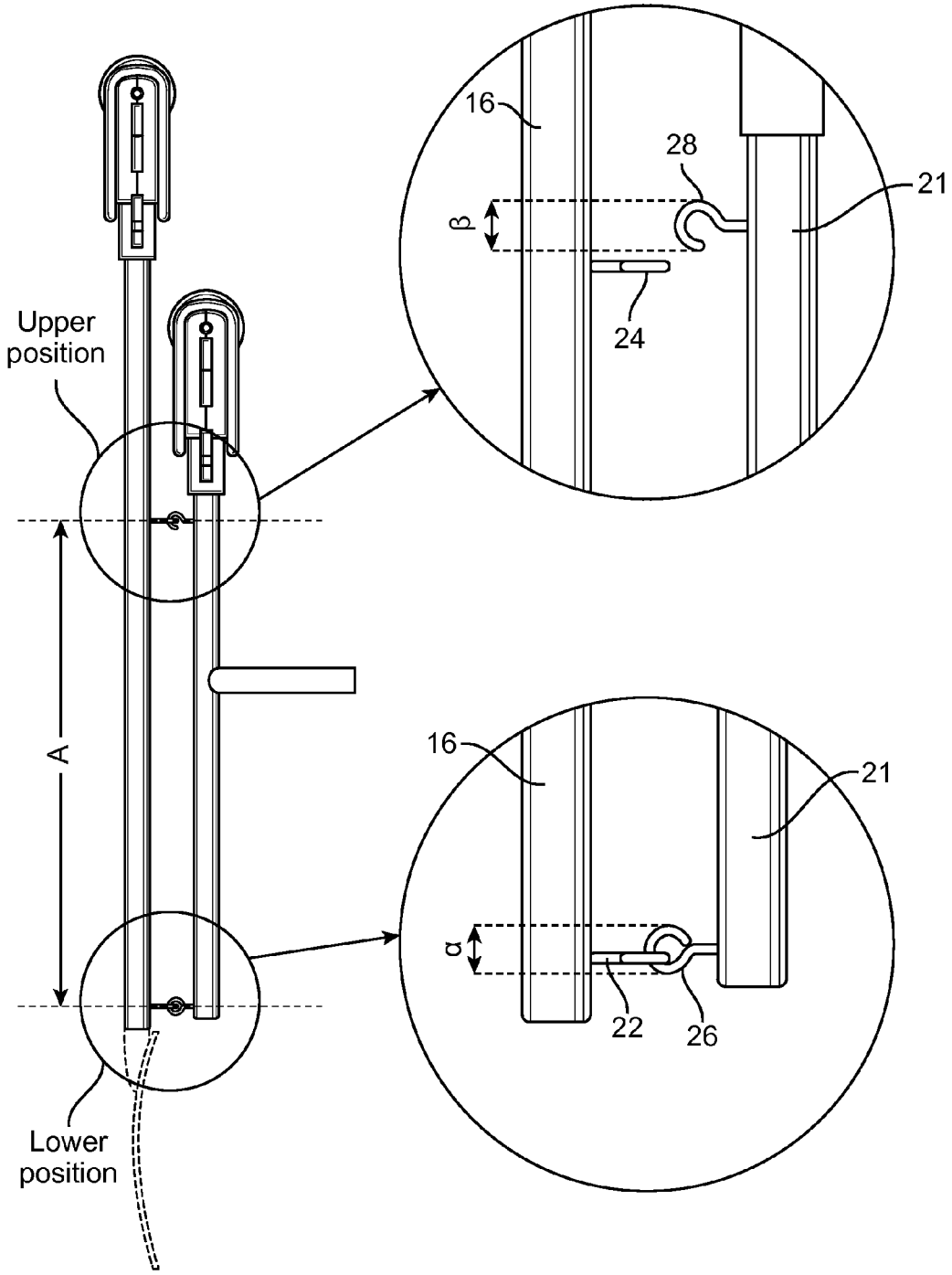
FIG. 5 shows a side view of the shovel illustrating an upper and lower position of the mechanical connections between the first and second shafts, in accordance with the present disclosure.
Figure 12:
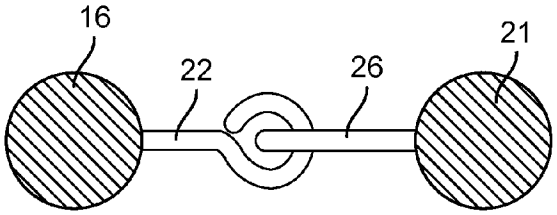
FIG. 12 is a cross sectional view taken along line A-A of FIG. 3, in accordance with the present disclosure.

FIG. 5 shows a side view of the shovel 10 illustrating an upper and lower position of the mechanical connections between the first and second shafts 16 and 21. As FIG. 5 shows, a distance from the lower position to the upper position may be represented as 'A'. The two interconnected eye screws or eye bolts 22 and 26 are at a lower position and the third eye screw or bolt 24 and the hook 28 are at an upper position. FIG. 12 shows the eye screws or eye bolts 22 and 26 engaged to one another at a view that is a 90-degree rotational from the view of the eye screws or eye bolts 22 and 26 shown in FIGS. 3-5.

Figure 6:
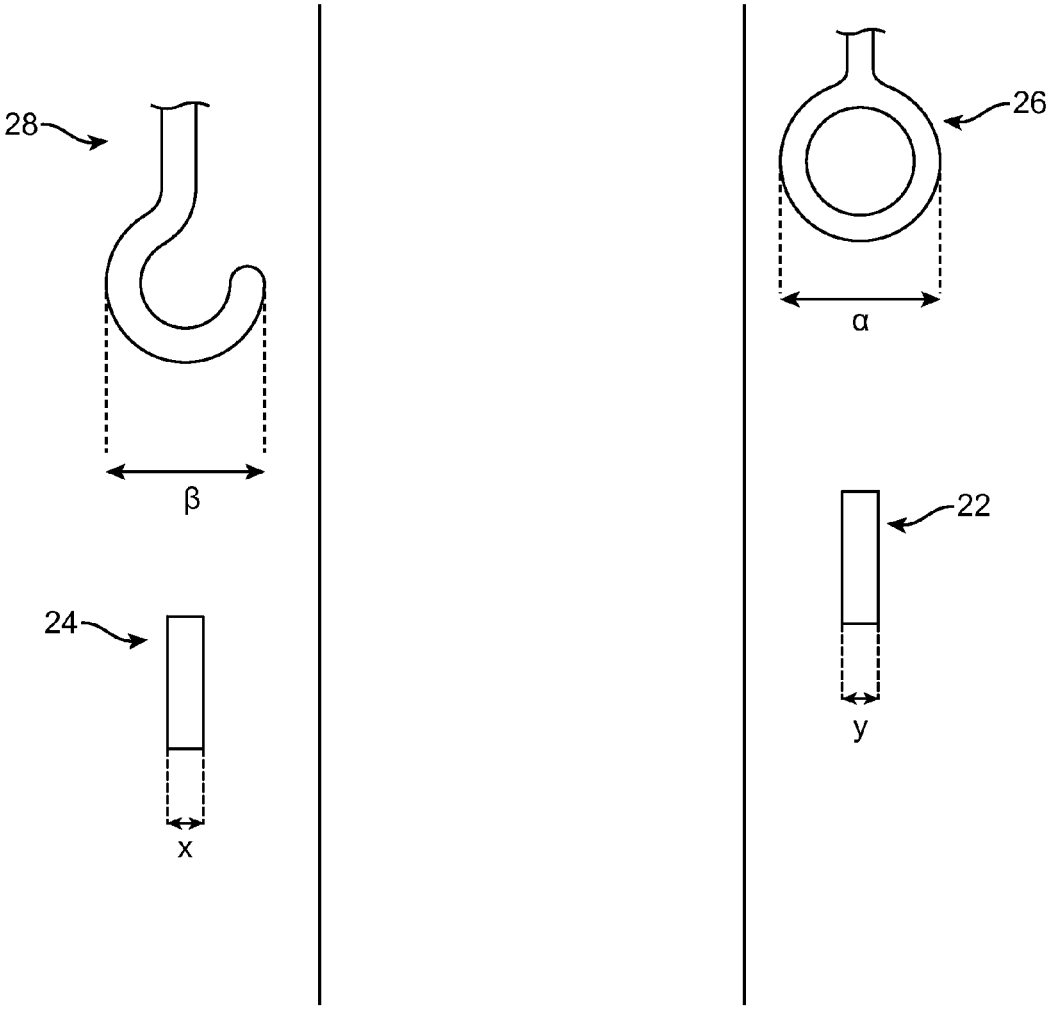
FIGS. 6 and 7 show components of the mechanical connections, in accordance with the present disclosure.
Figure 7:
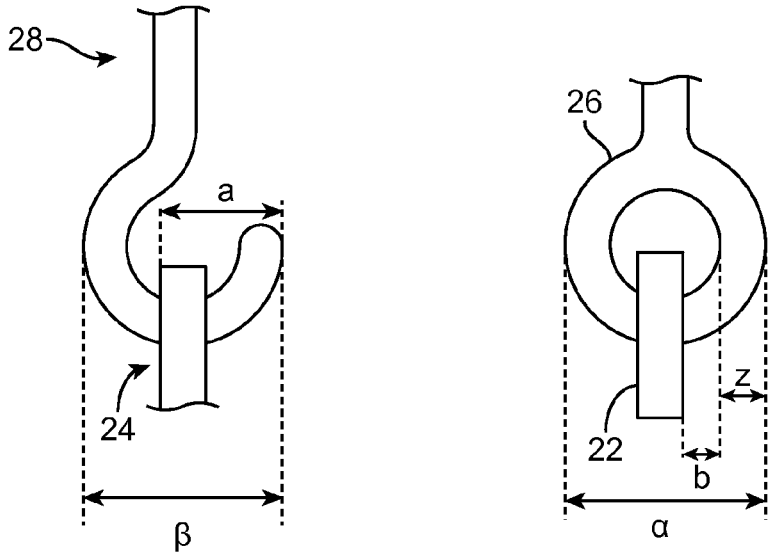

FIGS. 6 and 7 show the eye screws or eye bolts 22 and 26 and the third eye screw or bolt 24 and the hook 28 to illustrate dimensional representations. As FIG. 6 shows, a diameter of the nook 28 may be represented as 'β', a diameter of the eye screw or eye bolt 26 may be represented as 'α', a width of the eye screw or eye bolt 22 may be represented as 'y', and a width of the eye screw or eye bolt 24 may be represented as 'x'. FIG. 7 shows the eye screws or eye bolts 22 engaged with element 26 and the third eye screw or bolt 24 engaged to the hook 28.

Figure 3:
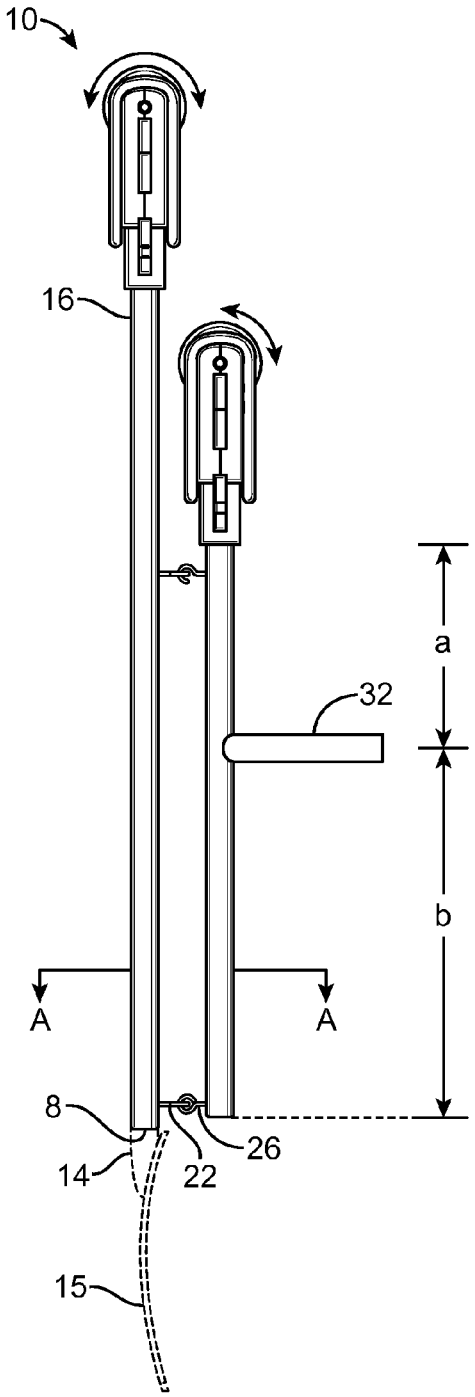
FIG. 3 is a left side view of the shovel as seen from a left side of FIG. 2, in accordance with the present disclosure.

In operation, a user may wish to switch from an engaged position of the second shaft, shown in FIG. 3 to a disengaged position as shown in FIG. 4. In an engaged position, a mid-point of the width of element 24 rests in a center of the diameter of the hook 28 and a mid-point of the width of element 22 rests in a center of the diameter of element 26. When transitioning from an engaged position to a disengaged position, element 24 moves a distance represented by 'a' and element 22 moves a distance represented by 'b'. Distances 'a' and 'b' are essentially equal. Distance 'a' may be described as: half the diameter of the hook 28 plus half of the width of element 24 and may be represented by equation (1):

$$a = \frac{1}{2}\beta + \frac{1}{2}x \tag{1}$$

Distance b may be described as: half the diameter of element 26 minus half of the width of element 22 and the width of element 26 'z' and may be represented by equation (2):

$$b = \frac{1}{2}\propto - \frac{1}{2}y - z \tag{2}$$

In one embodiment, the diameter of element 26 is larger than the diameter of the hook 28. In one embodiment, the diameter of element 26 is larger than the diameter of the hook 28 by at least two widths of the element 26. In one embodiment, the diameter of element 26 is larger than the diameter of the hook 28 by at least two widths of the element 26 and a width of element 24. In one embodiment, the diameter of element 26 is larger than the diameter of the hook 28 by at least two widths of the element 26 and a width of element 22. In one embodiment, the diameter of element 26 is larger than the diameter of the hook 28 by at least two widths of the element 26, a width of element 24, and a width of element 22.

In one embodiment, a length of the second handle assembly 30 may be configured to be adjusted.

Figure 8:
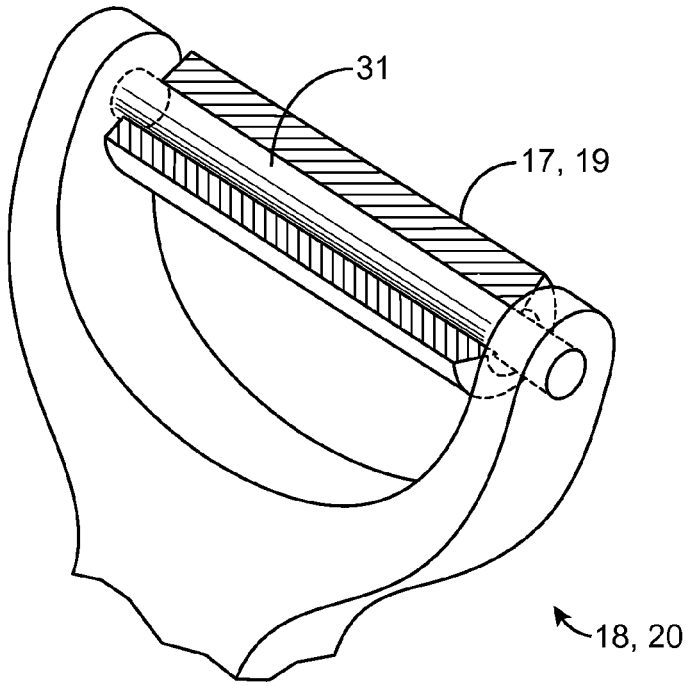
FIG. 8 is a cutaway view of first and second handles, in accordance with the present disclosure.

Shown in FIG. 8 is a cutaway view of first and second handles 18 and 20. Each handle includes a grip 17 and 19 that is a cylindrical tube made of suitable material for gripping that rotates about rod 31 that traverses across the mouth of each handle 18 and 20.

Figure 9:
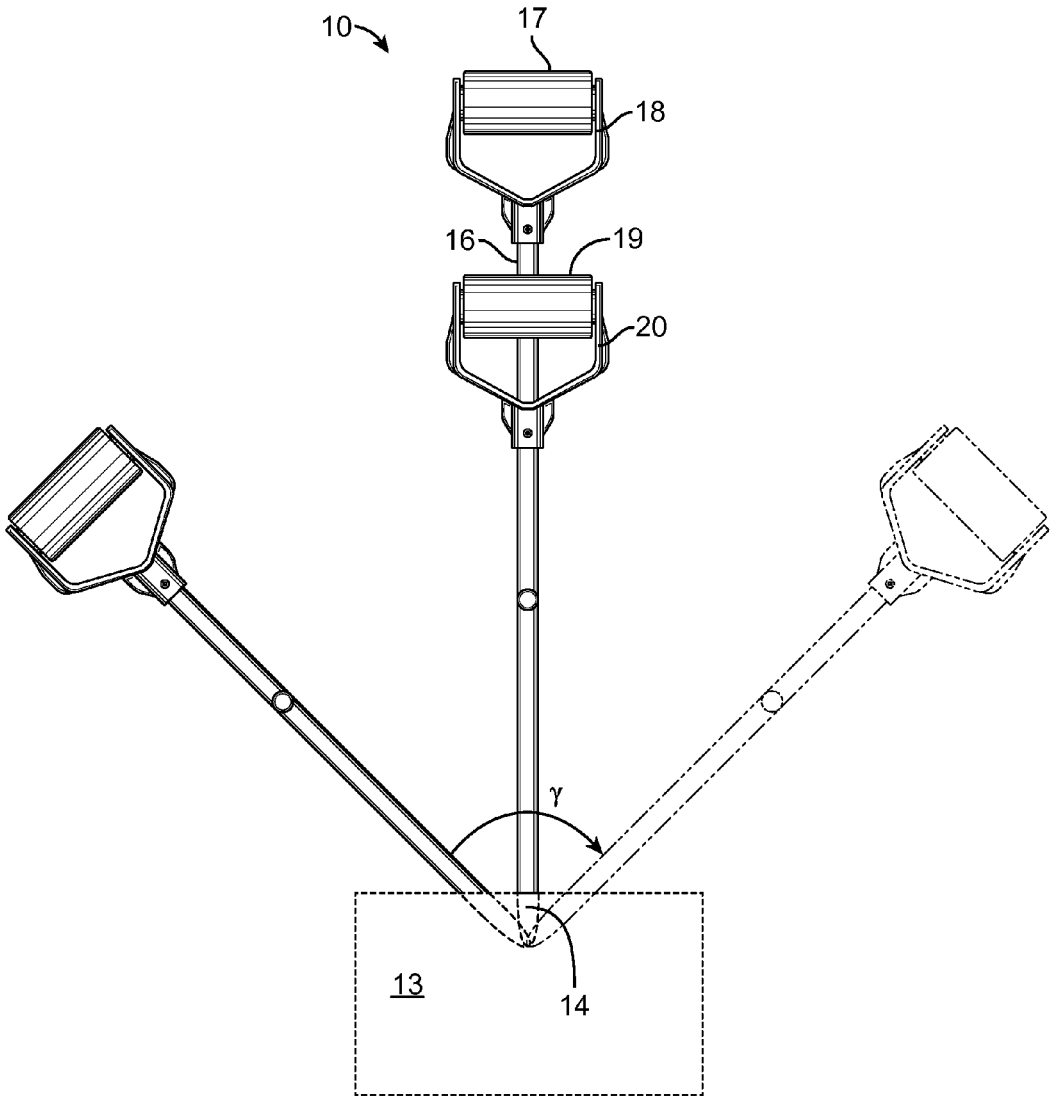
FIG. 9 is a front view of the shovel depicting rotational movement of the second shaft, in accordance with the present disclosure.

FIG. 9 illustrates lateral rotational movement γ of the second shaft 21 of an embodiment of the shovel 10. As FIG. 9 shows, the second shaft 21 is configured to rotate approximately 45-degrees to the left and approximately 45-degrees to the right with respect to the first shaft 16, i.e., approximately 90-degrees of rotation. In this way, different shoveling techniques may be utilized by an individual, e.g., incorporating more side-to-side movement of the shovel.

Figure 10:
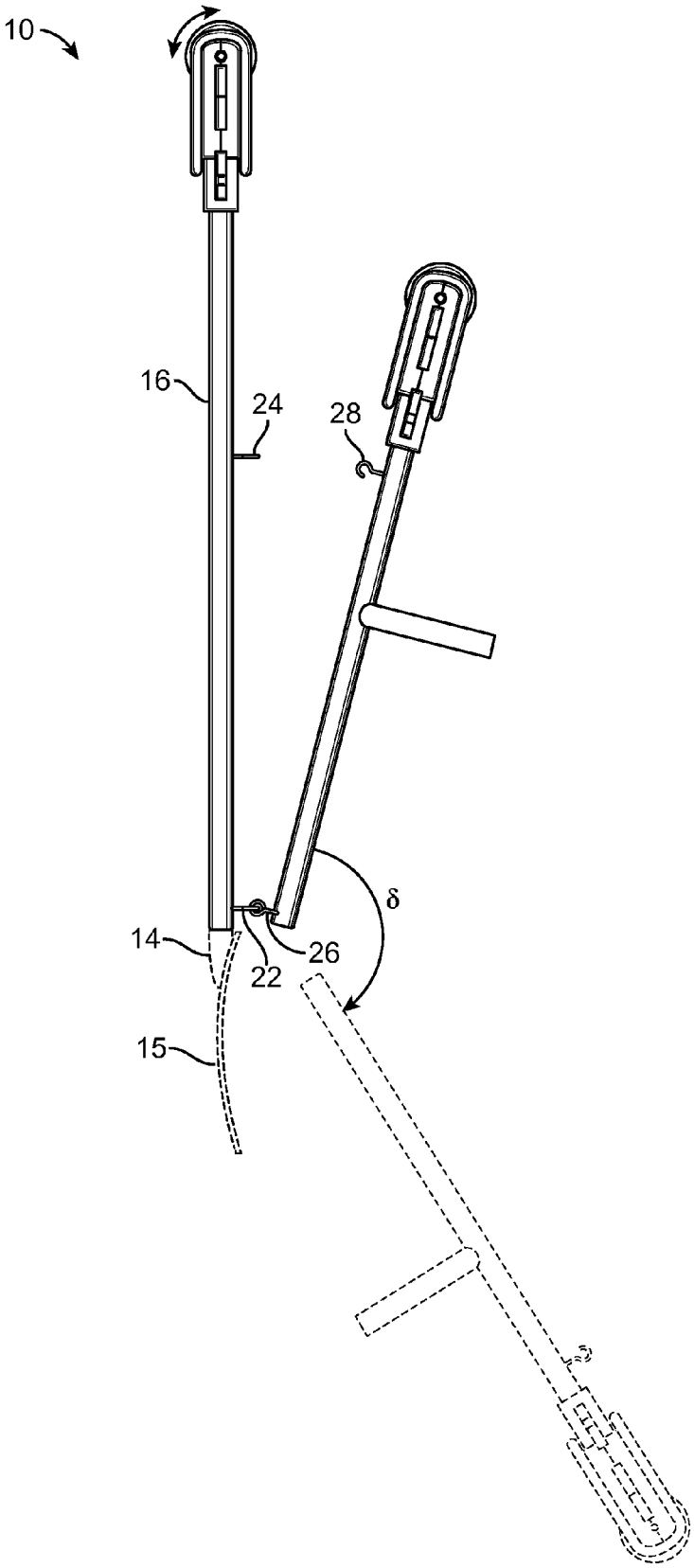
FIG. 10 is a side view of the shovel depicting rotational movement of the second shaft, in accordance with the present disclosure.

FIG. 10 illustrates vertical rotational movement δ of the second shaft 21 of an embodiment of the shovel 10 with respect to the first shaft 16. As FIG. 10 shows, the second shaft 21 is configured to rotate nearly 180-degrees with respect to the first shaft 16. By rotating vertically, a user may utilize pendulum-type movements to shovel snow or debris.

Figure 11:
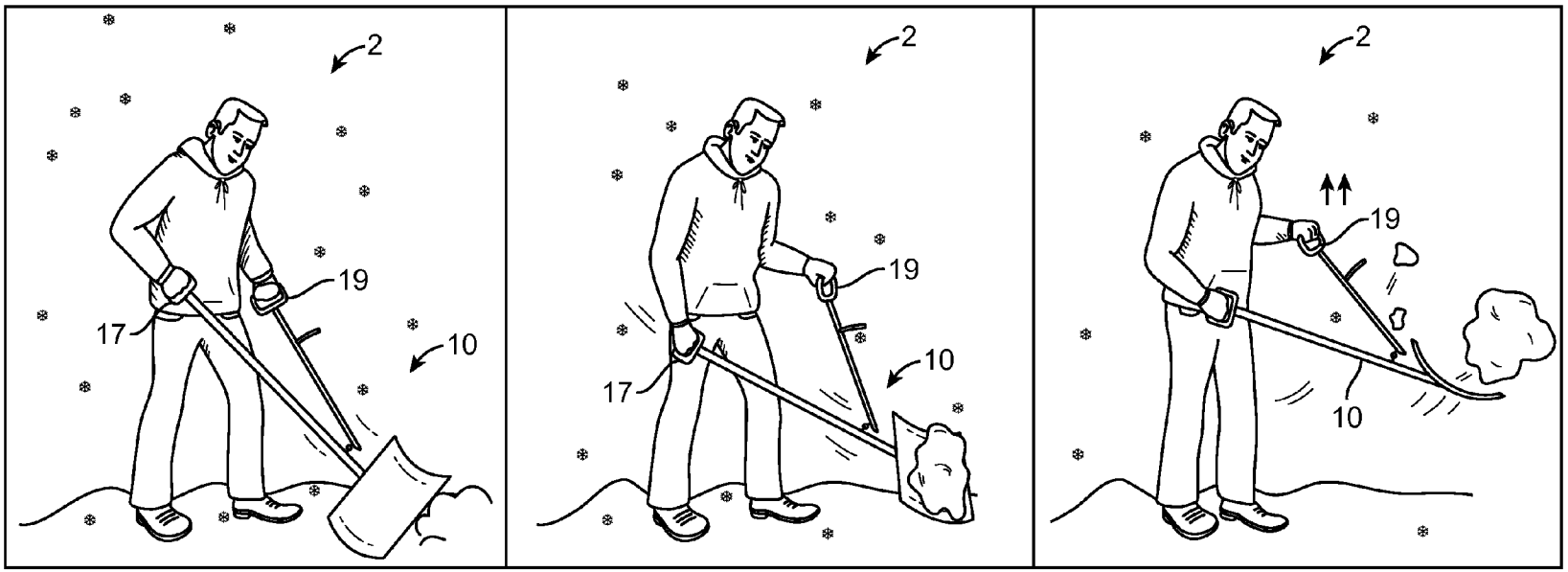
FIG. 11 illustrates an exemplary use of the shovel, in accordance with the present disclosure.

FIG. 11 shows an exemplary use of the shovel, in accordance with the present disclosure. As FIG. 11 shows, a user 2 may grab grips 17 and 19 of shovel 10 with their hands. As shovel 10 is swung back or pushed forwards, grips 17 and 19 rotate on the rods as described herein above. This permits the person to keep their wrists stationary or in a locked position as shovel 10 is used to lift or move a load.

Figure 13:
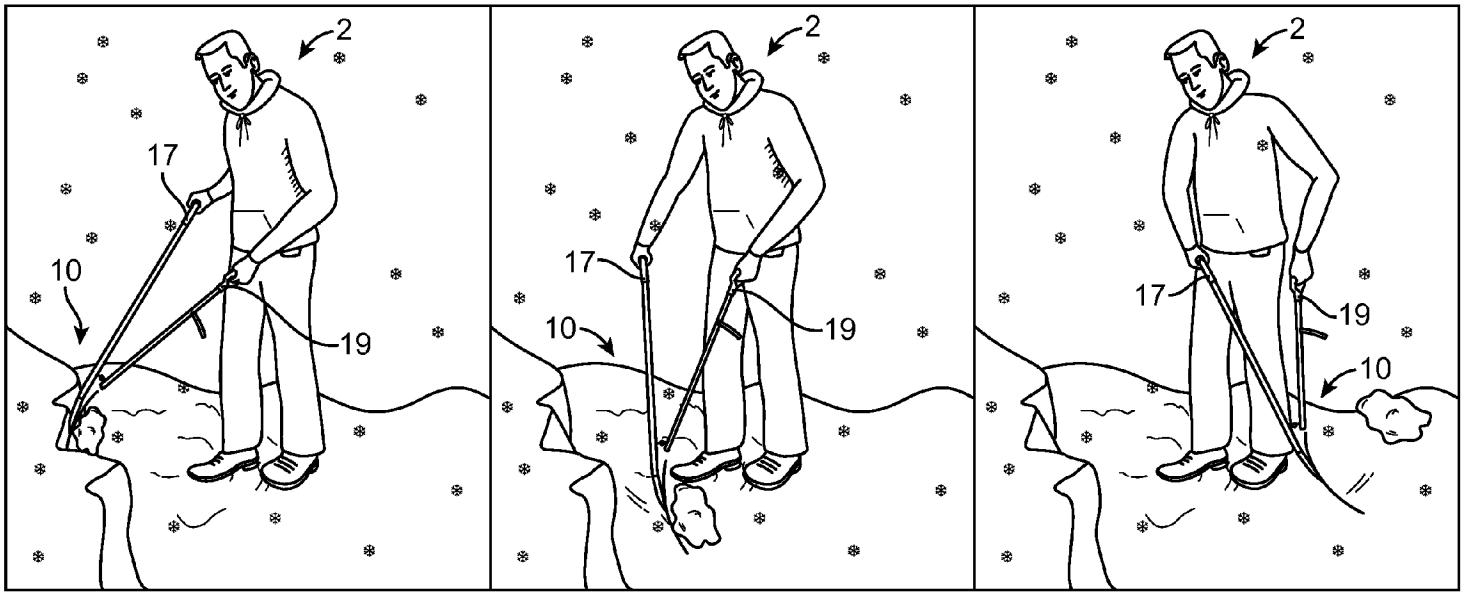
FIG. 13 illustrates an exemplary use of the shovel, in accordance with the present disclosure.

FIG. 13 shows another exemplary use of the shovel, in accordance with the present disclosure. As FIG. 13 shows, a user 2 may grab grips 17 and 19 of shovel 10 with their hands. User 2 then exerts a downward and pulling force upon the shove, thereby scraping or moving snow or debris toward the user 2. Use of the second handle in this manner better controls the shovel and requires less effort to scrap.

The disclosure has described certain preferred embodiments and modifications thereto. Further modifications and alterations may occur to others upon reading and understanding the specification. Therefore, it is intended that the disclosure not be limited to the particular embodiment(s) disclosed for carrying out this disclosure, but that the disclosure will include all embodiments falling within the scope of the appended claims.

The invention claimed is:

1. A shovel, comprising:

a first shaft having upper and lower ends defining a longitudinal axis;

a shovel blade having top and bottom edges, a concave front side and a convex rear side;

a first handle at the upper end of the first shaft defining a first axis, the first handle having a first grip, the first grip capable of rotating about the first axis;

a second handle assembly comprising a second shaft and a second grip, wherein the first and second shafts are selectively connected using a first hook and a first eye component and pivotally connected using a second eye component of the second shaft secured to a third eye component secured to the first shaft; and a third shaft connected to the second shaft at a substantially 90-degree angle.

2. The shovel of claim 1, wherein the second eye component has a larger diameter than the diameter of the hook.

3. The shovel of claim 1, wherein the second eye component comprises a diameter larger than a diameter of the hook by at least two widths of the second eye component.

4. The shovel of claim 1, wherein the second eye component comprises a diameter larger than the diameter of the hook by at least two widths of the second eye component and a width of first eye component.

5. The shovel of claim 1, wherein the second eye component comprises a diameter larger than the diameter of the hook by at least two widths of the second eye component and a width of third eye component.

6. The shovel of claim 1, wherein the second eye component comprises a diameter larger than the diameter of the hook by at least two widths of the second eye component, a width of the first eye component, and a width of third eye component.

7. The shovel of claim 1, wherein the third eye component is oriented perpendicular to the longitudinal axis of the first shaft and the opening of the third eye component is oriented parallel to the longitudinal axis of the first shaft.

8. The shovel of claim 1, wherein the first and third eye components are oriented perpendicular to the longitudinal axis of the first shaft and the openings of the first and third eye components are oriented parallel to the longitudinal axis of the first shaft;

wherein the second eye component is oriented parallel to the longitudinal axis of the second shaft and the opening of the second eye component is oriented perpendicular to the longitudinal axis of the second shaft; and wherein the hook is oriented parallel to the longitudinal axis of the second shaft.

9. A shovel, comprising:

a first shaft having upper and lower ends defining a longitudinal axis;

a shovel blade having top and bottom edges, a concave front side and a convex rear side;

a first handle at the upper end of the first shaft defining a first axis, the first handle having a first grip, the first grip capable of rotating about the first axis;

a second handle assembly comprising a second shaft, wherein the first and second shafts are selectively connected using a first hook and a first eye component and pivotally connected using a second eye component of the second shaft secured to a third eye component secured to the first shaft;

a second handle at the upper end of the second shaft defining a second axis, the second handle having a second grip, the second grip capable of rotating about the second axis; and a third shaft connected to the second shaft at a substantially 90-degree angle.

10. The shovel of claim 9, wherein the second eye component has a larger diameter than the diameter of the hook.

11. The shovel of claim 9, wherein the second eye component comprises a diameter larger than a diameter of the hook by at least two widths of the second eye component.

12. The shovel of claim 9, wherein the second eye component comprises a diameter larger than the diameter of the hook by at least two widths of the second eye component and a width of first eye component.

13. The shovel of claim 9, wherein the second eye component comprises a diameter larger than the diameter of the hook by at least two widths of the second eye component and a width of third eye component.

14. The shovel of claim 9, wherein the second eye component comprises a diameter larger than the diameter of the hook by at least two widths of the second eye component, a width of the first eye component, and a width of third eye component.

15. The shovel of claim 9, wherein the third eye component is oriented perpendicular to the longitudinal axis of the first shaft and the opening of the third eye component is oriented parallel to the longitudinal axis of the first shaft.

16. The shovel of claim 9, wherein the first and third eye components are oriented perpendicular to the longitudinal axis of the first shaft and the openings of the first and third eye components are oriented parallel to the longitudinal axis of the first shaft;

wherein the second eye component is oriented parallel to the longitudinal axis of the second shaft and the opening of the second eye component is oriented perpendicular to the longitudinal axis of the second shaft; and wherein the hook is oriented parallel to the longitudinal axis of the second shaft.

17. A shovel, comprising:

a first shaft having upper and lower ends defining a longitudinal axis;

a shovel blade having top and bottom edges, a concave front side and a convex rear side;

a first handle at the upper end of the first shaft defining a first axis, the first handle having a first grip, the first grip capable of rotating about the first axis;

a second handle assembly comprising a second shaft, wherein the first and second shafts are selectively connected using a first hook and a first eye component and pivotally connected using a second eye component of the second shaft secured to a third eye component secured to the first shaft, wherein the second eye component comprises a diameter larger than the diameter of the hook by at least two widths of the second eye component, a width of the first eye component, and a width of third eye component;

a second handle at the upper end of the second shaft defining a second axis, the second handle having a second grip, the second grip capable of rotating about the second axis; and a third shaft connected to the second shaft at a substantially 90-degree angle.

18. The shovel of claim 17, wherein the third eye component is oriented perpendicular to the longitudinal axis of the first shaft and the opening of the third eye component is oriented parallel to the longitudinal axis of the first shaft.

19. The shovel of claim 18, wherein the first and third eye components are oriented perpendicular to the longitudinal axis of the first shaft and the openings of the first and third eye components are oriented parallel to the longitudinal axis of the first shaft;

wherein the second eye component is oriented parallel to the longitudinal axis of the second shaft and the opening of the second eye component is oriented perpendicular to the longitudinal axis of the second shaft; and wherein the hook is oriented parallel to the longitudinal axis of the second shaft.

20. The shovel of claim 19, wherein the pivotal connection of the first and second shafts is configured for lateral rotation of approximately 90-degrees and vertical rotational of nearly 180-degrees of the second shaft with respect to the first shaft.

* * * * *